US005664751A

United States Patent [19]

Lan

[11] Patent Number: 5,664,751

[45] Date of Patent: Sep. 9, 1997

[54] ARTICLE HOLDER

[76] Inventor: Chun-Min Lan, 58, Ma Yuan West St., Taichung, Taiwan

[21] Appl. No.: 695,730

[22] Filed: Aug. 12, 1996

[51] Int. Cl.[6] ..... A47G 29/00

[52] U.S. Cl. ..... 248/251; 248/309.1

[58] Field of Search ..... 248/220.21, 251, 248/309.1, 315

[56] References Cited

U.S. PATENT DOCUMENTS

| | | | |
|---|---|---|---|
| 1,838,935 | 12/1931 | Fixsen | 248/251 X |
| 1,852,262 | 4/1932 | Pleiss | 248/251 |
| 2,158,734 | 5/1939 | Sladek | 248/251 |
| 4,979,713 | 12/1990 | Bell | 248/251 X |
| 5,026,012 | 6/1991 | Wang | 248/251 X |
| 5,026,013 | 6/1991 | Robbins | 248/251 X |
| 5,071,099 | 12/1991 | Kuo | 248/251 X |
| 5,186,427 | 2/1993 | Semchuck | 248/251 |
| 5,402,977 | 4/1995 | Korfgen et al. | 248/309.1 |

*Primary Examiner*—Carl D. Friedman
*Assistant Examiner*—Aimee E. McTigue

[57] ABSTRACT

An article holder comprises a base, a bracket, a collar, and a cover. The base has a disk, a plurality of hollow posts and a fence disposed on the disk. A threaded socket is disposed on a center of the base. A threaded through hole is formed in the threaded socket. A plurality of slots are formed on the base. The bracket has an annular seat and a hollow mount disposed on two opposite ends of the bracket. A crossbar is disposed on the annular seat. A round hole is formed on a center of the crossbar. The annular seat is disposed on the disk to surround the fence. A collar is disposed on the annular seat. A cover is disposed on the collar. A threaded recess hole is formed on the cover. A plurality of studs fasten the disk on a wall via the corresponding slots. A bolt passes through the round hole and the threaded through hole. The threaded recess hole engages with a distal end of the bolt.

1 Claim, 9 Drawing Sheets

ARTICLE HOLDER

BACKGROUND OF THE INVENTION

The invention relates to an article holder. More particularly, the invention relates to an article holder in a bathroom.

Most conventional article holders are adhered on walls. These article holders may be easily fallen down after holding heavy articles for a long period of time.

SUMMARY OF THE INVENTION

An object of the invention is to provide an article holder which can be fastened on a wall of a bathroom stably.

Accordingly, an article holder comprises a base, a bracket, a collar, and a cover. The base has a disk, a plurality of hollow posts disposed on the disk, and a fence disposed on the disk to surround the hollow posts. A threaded socket is disposed on a center of the base. A threaded through hole is formed in the threaded socket. A plurality of slots are formed on the base. The bracket has an annular seat disposed on a first end of the bracket and a hollow mount disposed on a second end of the bracket. A crossbar is disposed on the annular seat. A round hole is formed on a center of the crossbar. The annular seat is disposed on the disk to surround the fence. The collar is disposed on the annular seat. The cover is disposed on the collar. A threaded recess hole is formed on the cover. A plurality of studs fasten the disk on a wall via the corresponding slots. A bolt passes through the round hole and the threaded through hole. A nut screws on a distal portion of the bolt. The threaded recess hole engages with a distal end of the bolt.

According to the second embodiment, another article holder has a base, a bracket, a collar, and a cover. The collar is disposed on the bracket. The cover is disposed on the collar. The bracket has an elongated arm. Two hollow seats are formed in the elongated arm to receive two corresponding rods. A towel is hung on the rod.

According to the third embodiment, an article holder has a base, a bracket, a collar, and a cover. The collar is disposed on the bracket. The cover is disposed on the collar. A cup holder is disposed on a distal end of the bracket. A circular recess and a plurality of oblong holes are formed on the cup holder. The circular recess receives a cup. A toothbrush is inserted in the oblong hole.

According to the fourth embodiment, an article holder has a base, a bracket, a collar, and a cover. The collar is disposed on the bracket. The cover is disposed on the collar. An ashtray holder is disposed on the bracket. An annular hoop is disposed on a distal end of the ashtray holder to receive an ashtray.

According to the fifth embodiment, an article holder has a base, a bracket, a collar, and a cover. The collar is disposed on the bracket. The cover is disposed on the collar. A shortened arm is disposed on the bracket. A hollow sleeve is disposed on a distal end of the shortened arm. A loop is positioned by the hollow sleeve. A bath towel is hung on the loop.

According to the sixth embodiment, an article holder has a base, a bracket, a collar, and a cover. The collar is disposed on the bracket. The cover is disposed on the collar. A leg extends downward from the bracket. A clip mount is disposed beneath the leg. A panel is inserted through the clip mount. A screw fastens the panel and the clip mount together.

BRIEF DESCRIPTION OF THE DRAWINGS

FIG. 2 is a sectional assembly view of FIG. 1;

DETAILED DESCRIPTION OF THE INVENTION

Figure 1:
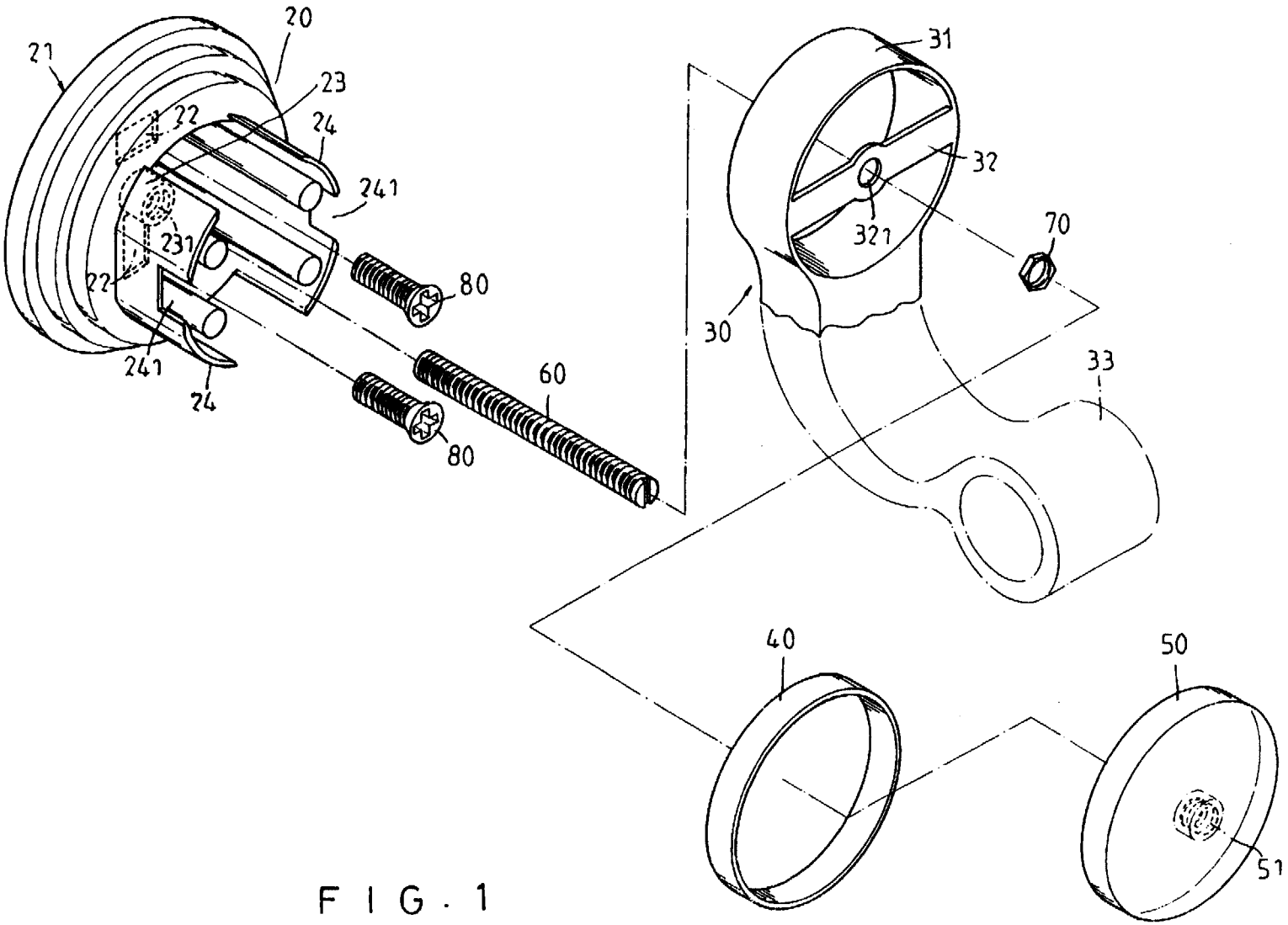
FIGS. 1 to 3 are perspective exploded views of an article holder of a first preferred embodiment in accordance with the invention.
Figure 2:
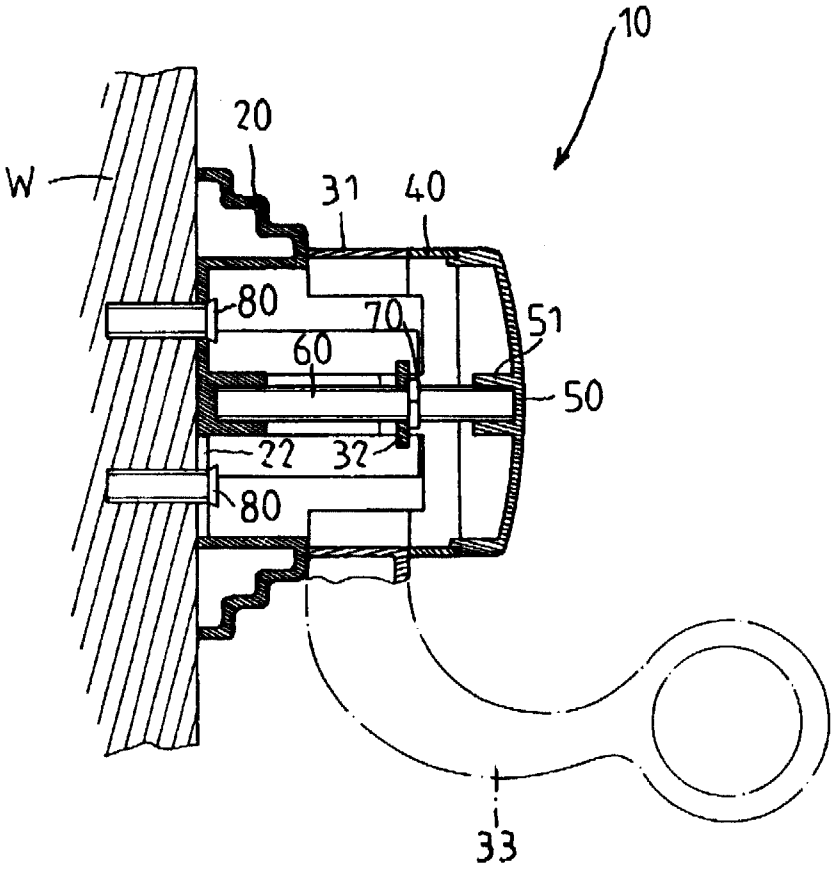

Referring to FIGS. 1 and 2, an article holder 10 has a base 20, a bracket 30, a collar 40, and a cover 50. The base 20 has a disk 21, a plurality of hollow posts 241 disposed on the disk 21, and a fence 24 disposed on the disk 21 to surround the hollow posts 241. A threaded socket 23 is disposed on a center of the base 20. A threaded through hole 231 is formed in the threaded socket 23. A plurality of slots 22 are formed on the base 20. The bracket 30 has an annular seat 31 disposed on a first end of the bracket 30 and a hollow mount 33 disposed on a second end of the bracket 30. A crossbar 32 is disposed on the annular seat 31. A round hole 321 is formed on a center of the crossbar 32. The annular seat 31 is disposed on the disk 21 to surround the fence 24. The collar 40 is disposed on the annular seat 31. The cover 50 is disposed on the collar 40. A threaded recess hole 51 is formed on the cover 50. A plurality of studs 80 fasten the disk 21 on a wall W via the corresponding slots 22. A bolt 60 passes through the round hole 321 and the threaded through hole 231. A nut 70 screws on a distal portion of the bolt 60. The threaded recess hole 51 engages with a distal end of the bolt 60.

Figure 3:
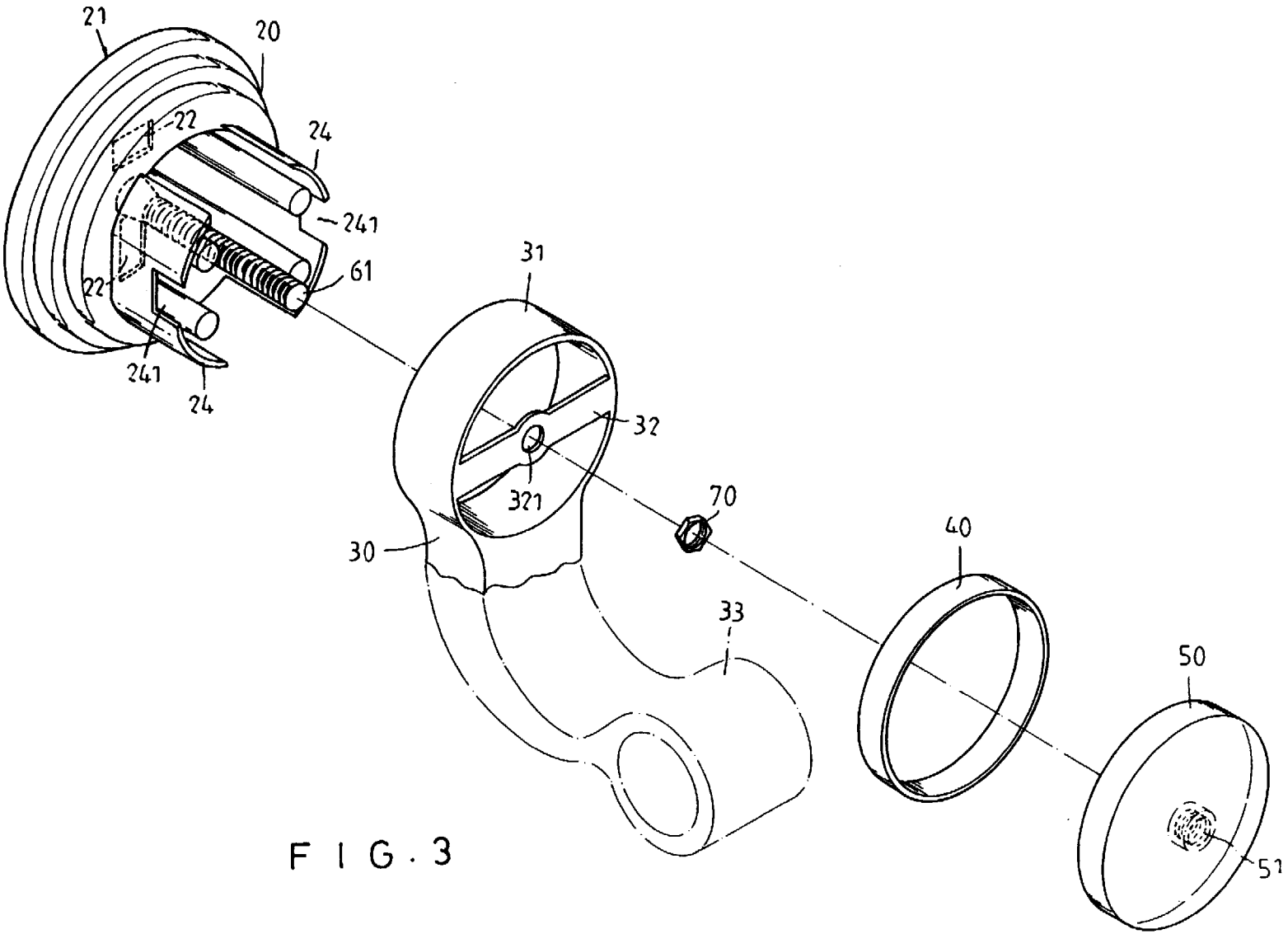
Figure 4:
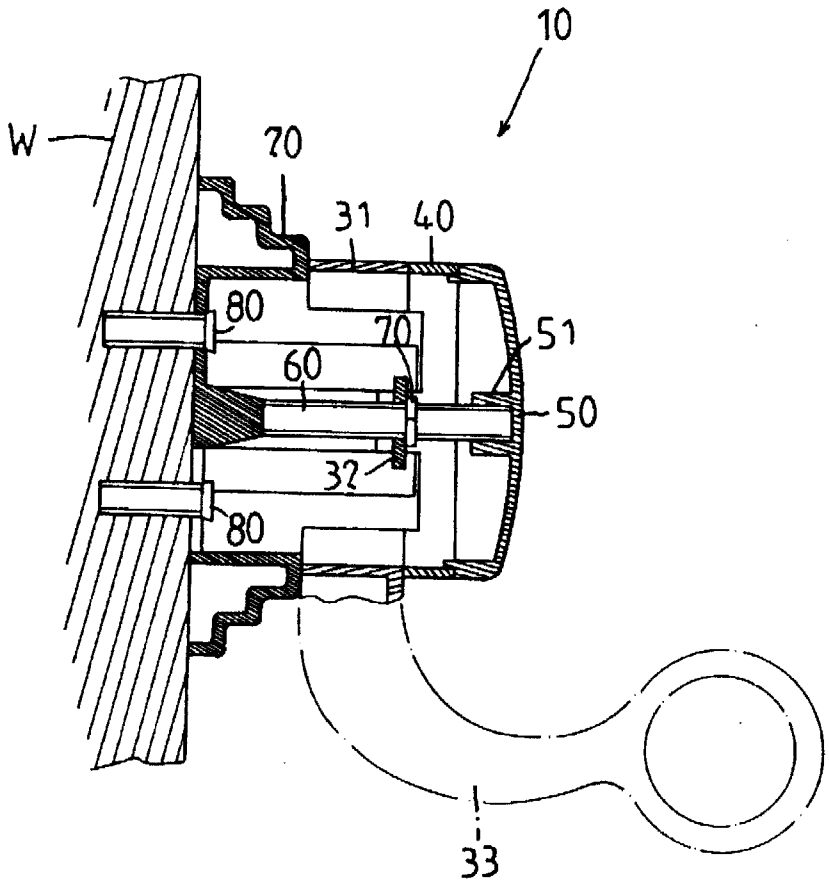
FIG. 4 is a sectional assembly view of FIG. 2.

Referring to FIGS. 3 and 4, A threaded post 61 is disposed on the center of the disk 21 instead of the threaded socket 23 and the bolt 60. Therefore, the function of the threaded post 61 is the same as the function of the threaded socket 23 in addition to the bolt 60.

Figure 5:
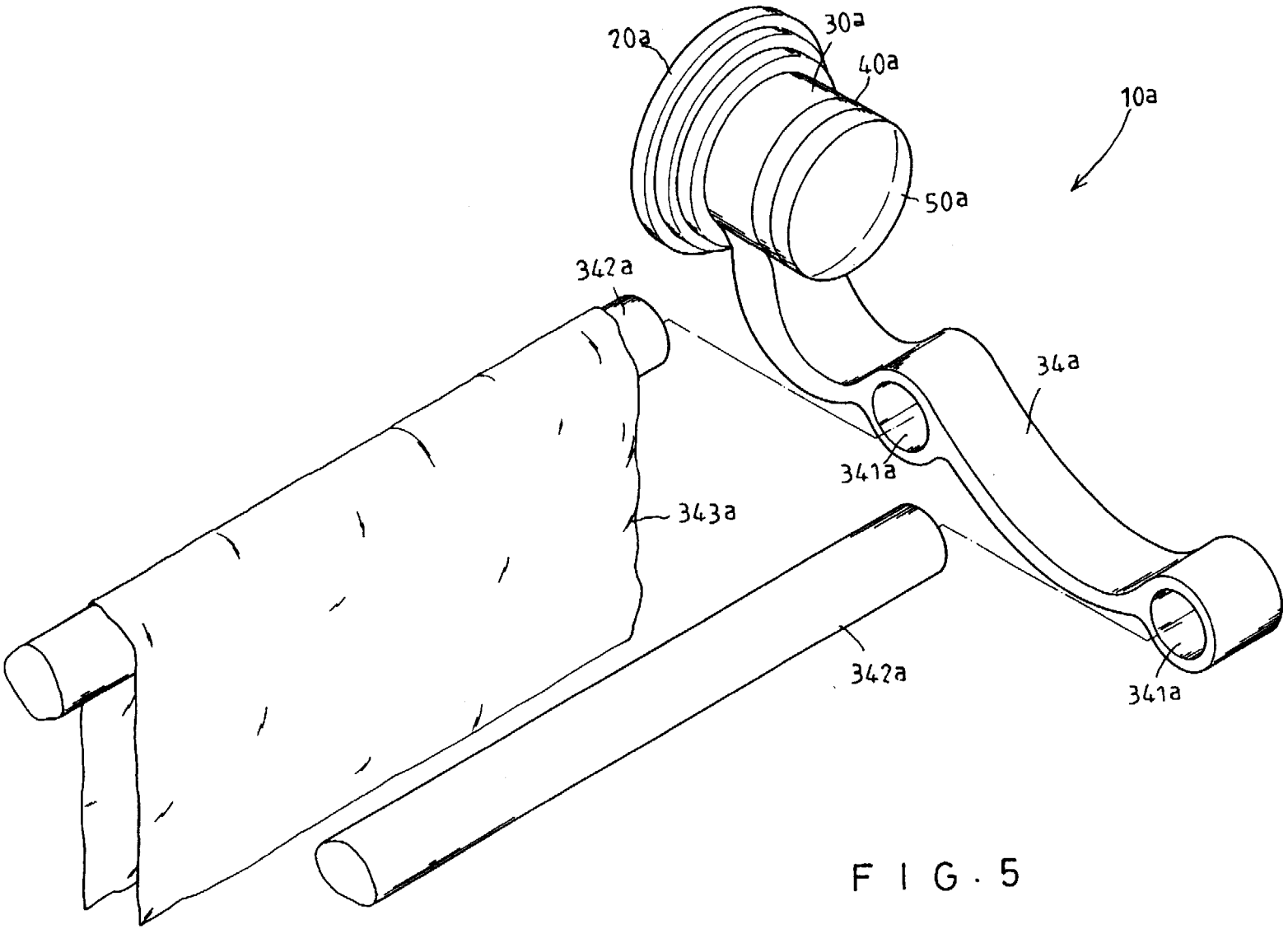
FIG. 5 is a perspective assembly view of an article holder of a second preferred embodiment in accordance with the invention.

Referring to FIG. 5, another article holder **10*a* has a base 20*a*, a bracket 30*a*, a collar 40*a*, and a cover 50*a*. The collar 40*a* is disposed on the bracket 30*a*. The cover 50*a* is disposed on the collar 40*a*. The bracket 30*a* has an elongated arm 34*a*. Two hollow seats 341*a* are formed in the elongated arm 34*a* to receive two corresponding rods 342*a* . A towel 343*a* is hung on the rod 342*a***.

Figure 6:
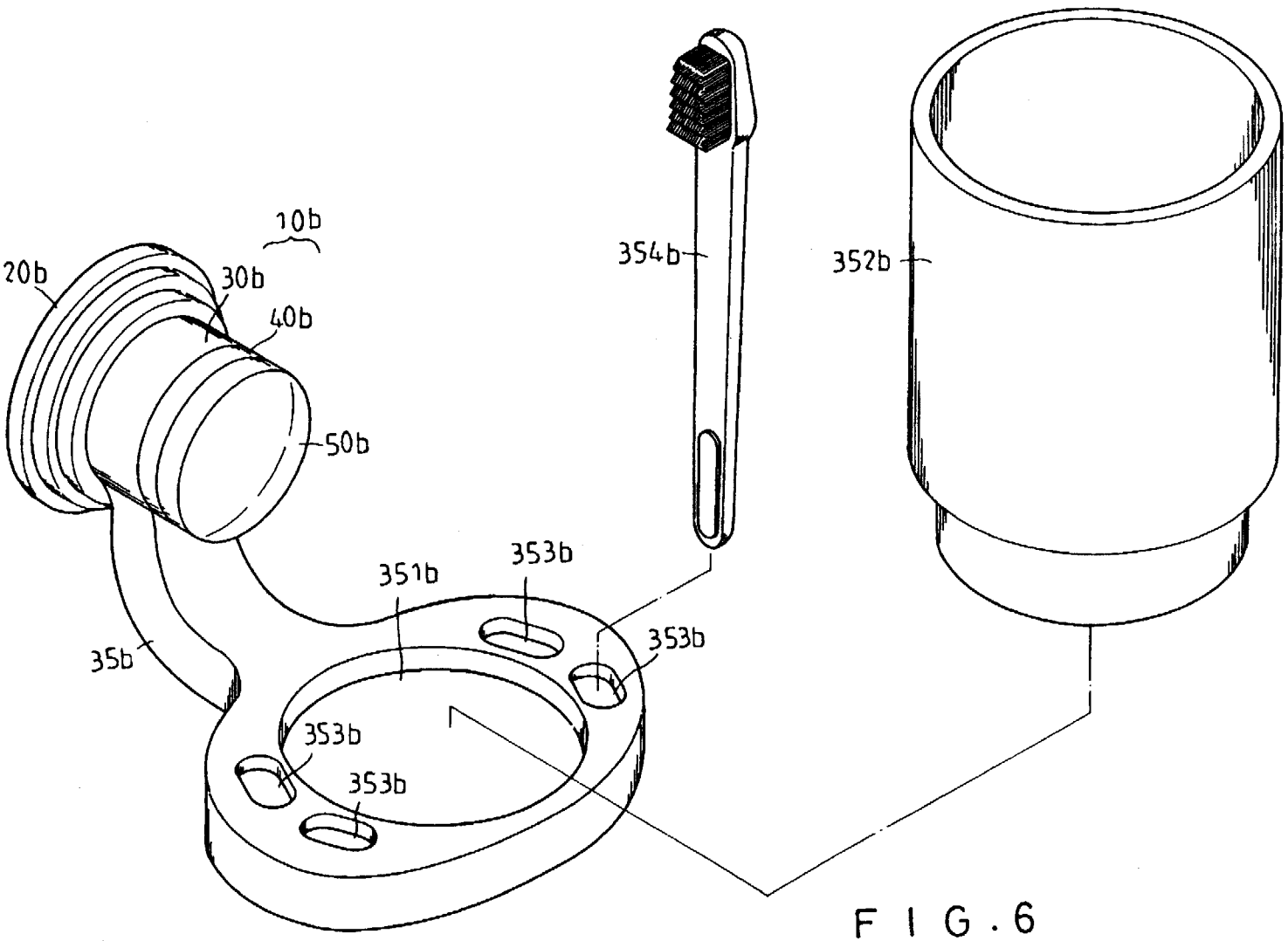
FIG. 6 is a perspective assembly view of an article holder of a third preferred embodiment in accordance with the invention.

Referring to FIG. 6, a third article holder **10*b* has a base 20*b*, a bracket 30*b*, a collar 40*b*, and a cover 50*b*. The collar 40*b* is disposed on the bracket 30*b*. The cover 50*b* is disposed on the collar 40*b*. A cup holder 35*b* is disposed on a distal end of the bracket 30*b*. A circular recess 351*b* and a plurality of oblong holes 353*b* are formed on the cup holder 35*b*. The circular recess 351*b* receives a cup 352*b*. A toothbrush 354*b* is inserted in the oblong hole 353*b***.

Figure 7:
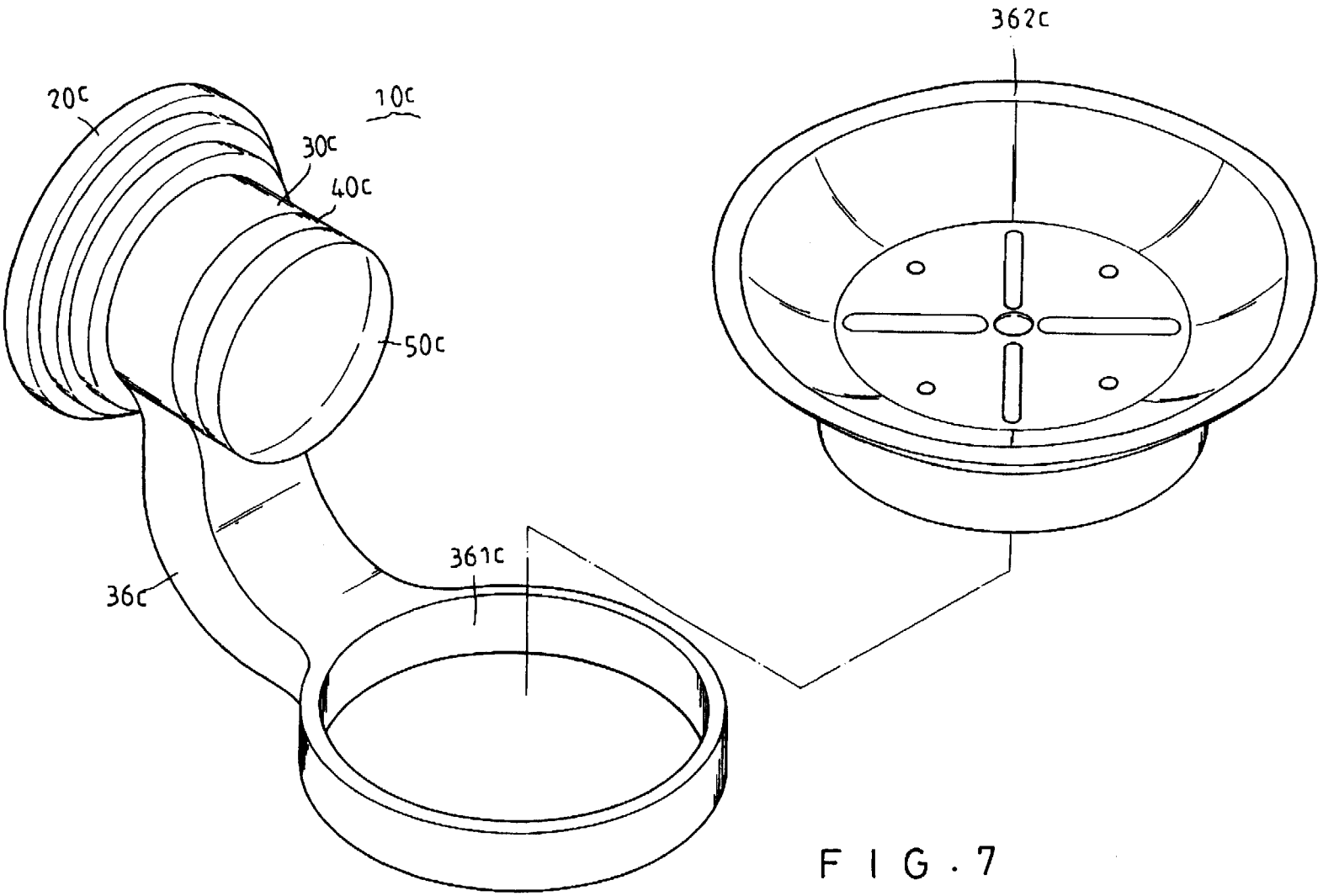
FIG. 7 is a perspective assembly view of an article holder of a fourth preferred embodiment in accordance with the invention.

Referring to FIG. 7, a fourth article holder **10*c* has a base 20*c*, a bracket 30*c*, a collar 40*c*, and a cover 50*c*. The collar 40*c* is disposed on the bracket 30*c*. The cover 50*c* is disposed on the collar 40*c*. An ashtray holder 36*c* is disposed on the bracket 30***c*. An annular hoop 361*c* is disposed on a distal end of the ashtray holder 36*c* to receive an ashtray 362*c*.

Figure 8:
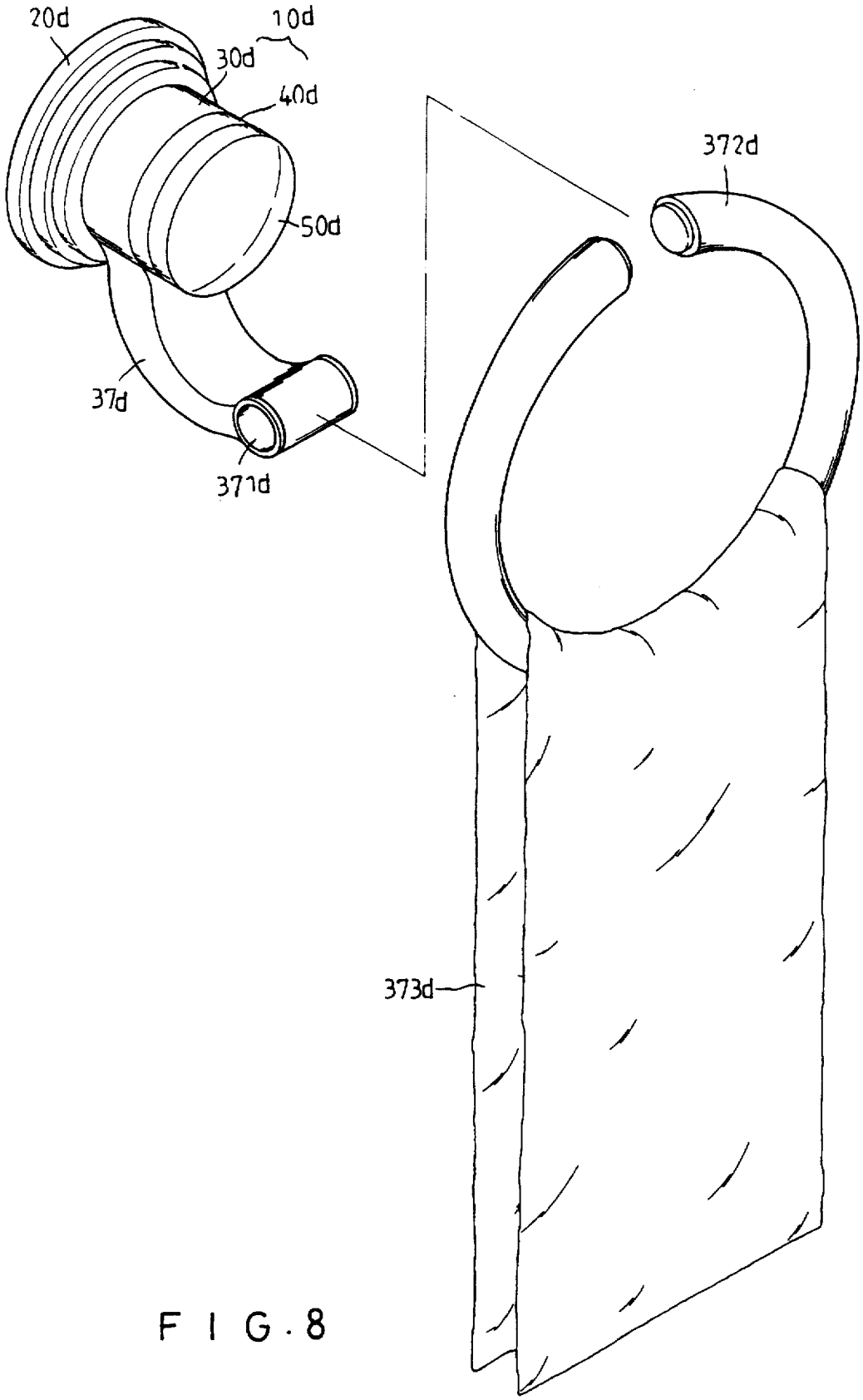
FIG. 8 is a perspective assembly view of an article holder of a fifth preferred embodiment in accordance with the invention.

Referring to FIG. 8, a fifth article holder 10*d* has a base 20*d*, a bracket 30*d*, a collar 40*d*, and a cover 50*d*. The collar 40*d* is disposed on the bracket 30*d*. The cover 50*d* is disposed on the collar 40*d*. A shortened arm 37*d* is disposed on the bracket 30*d*. A hollow sleeve 371*d* is disposed on a distal end of the shortened arm 37*d*. A loop 372*d* is positioned by the hollow sleeve 371*d*. A bath towel 373*d* is hung on the loop 372*d*.

Figure 9:
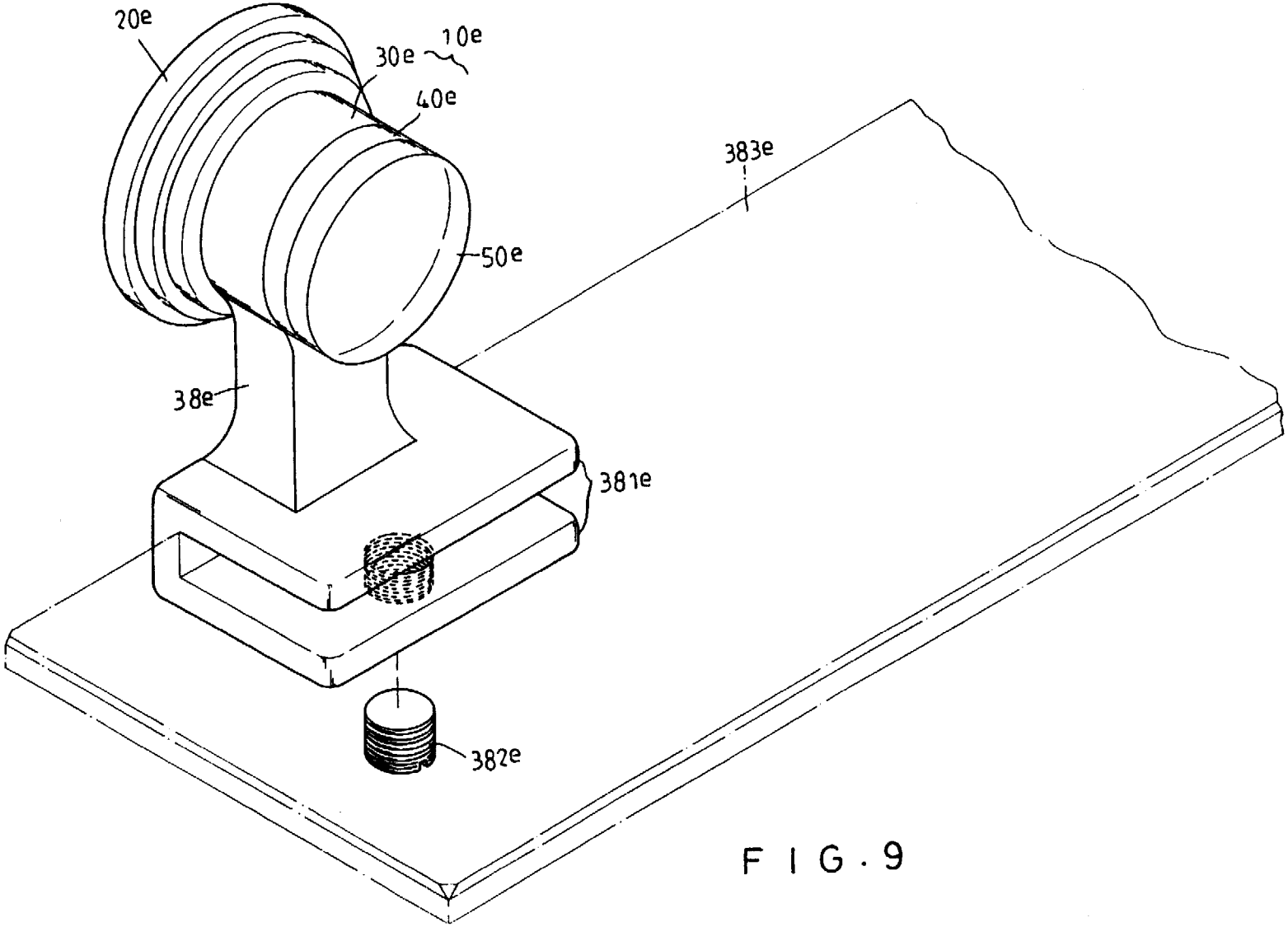
FIG. 9 is a perspective assembly view of an article holder of a sixth preferred embodiment in accordance with the invention.

Referring to FIG. 9, a sixth article holder 10*e* has a base 20*e*, a bracket 30*e*, a collar 40*e*, and a cover 50*e*. The collar 40*e* is disposed on the bracket 30*e*. The cover 50*e* is disposed on the collar 40*e*. A leg 38*e* extends downward from the bracket 30*e*. A clip mount 381*e* is disposed beneath the leg 38*e*. A panel 383*e* is inserted through the clip mount 381*e*. A screw 382*e* fastens the panel 383*e* and the clip mount 381*e* together.

The invention is not limited to the above embodiment but various modification thereof may be made. Further, various changes in form and detail may be made without departing from the scope of the invention.

I claim:

1. An article holder comprises:

a base, a bracket, a collar, and a cover, the base having a disk, a plurality of hollow posts disposed on the disk, and a fence disposed on the disk to surround the hollow posts, a threaded socket disposed on a center of the base, a threaded through hole formed in the threaded socket, a plurality of slots formed on the base, the bracket having an annular seat disposed on a first end of the bracket and a hollow mount disposed on a second end of the bracket, a crossbar disposed on the annular seat, a round hole formed on a center of the crossbar, the annular seat disposed on the disk to surround the fence, the collar disposed on the annular seat, the cover disposed on the collar, a threaded recess hole formed on the cover, a plurality of studs fastening the disk on a wall via the corresponding slots, a bolt passing through the round hole and the threaded through hole, the threaded recess hole engaging with a distal end of the bolt.

* * * * *